United States Patent [19]

Mrenna et al.

[11] Patent Number: 4,503,408

[45] Date of Patent: Mar. 5, 1985

[54] MOLDED CASE CIRCUIT BREAKER APPARATUS HAVING TRIP BAR WITH FLEXIBLE ARMATURE INTERCONNECTION

[75] Inventors: Stephen A. Mrenna, Beaver; Glenn R. Thomas, Brighton Township, Beaver County; Charles E. Haugh, Daugherty Township, Beaver County, all of Pa.

[73] Assignee: Westinghouse Electric Corp., Pittsburgh, Pa.

[21] Appl. No.: 440,681

[22] Filed: Nov. 10, 1982

[51] Int. Cl.[3] ..... H01H 73/48

[52] U.S. Cl. ..... 335/35; 335/23

[58] Field of Search ..... 335/8, 9, 10, 38, 42, 335/43, 45, 23, 35; 337/54

[56] References Cited

U.S. PATENT DOCUMENTS

| | | | |
|---|---|---|---|
| 2,294,838 | 9/1942 | Dorfman | 335/9 |
| 2,426,880 | 9/1947 | Jackson et al. | 335/23 |
| 2,939,929 | 6/1960 | Hobson, Jr. | 335/38 |
| 3,946,345 | 3/1976 | Gryctko et al. | 335/9 |
| 4,231,006 | 10/1980 | Belttory | 335/43 |

*Primary Examiner*—E. A. Goldberg
*Assistant Examiner*—George Andrews
*Attorney, Agent, or Firm*—M. J. Moran

[57] ABSTRACT

A molded case circuit breaker apparatus is taught with an operating mechanism which is triggered in response to the movement of a trip bar. The trip bar in turn is responsive to current flowing in the main terminals of the circuit breaker apparatus. The trip bar is responsive to electrothermal conditions as a gradual overload increases. It is also responsive to a short circuit condition due to a magnetic reaction between an armature and an electromagnet. The armature is flexibly attached to the trip bar for flexible movement in one direction and non-flexible movement in the other direction so that a short circuit may be accommodated by a relatively small air gap by non-flexible movement of the armature and the trip bar to cause a tripping operation. On the other hand, a wide range of angular movement is available for a high degree of calibrated reaction to a wide range of overload currents because the armature member is flexibly attached to the trip bar in one direction and is held stationary against the facing magnet even after the trip bar continues movement for an otherwise non-allowable increment of electrothermal calibration.

2 Claims, 12 Drawing Figures

MOLDED CASE CIRCUIT BREAKER APPARATUS HAVING TRIP BAR WITH FLEXIBLE ARMATURE INTERCONNECTION

BACKGROUND OF THE INVENTION

The subject matter of this invention is related generally to molded case circuit breakers and more particularly to the tripping mechanism for molded case circuit breaker apparatus.

Circuit breaker apparatus is taught in U.S. Pat. No. 4,116,205, issued Aug. 28, 1979 to Maier et al and U.S. Pat. No. 3,863,042, issued Jan. 28, 1975 to R. Nicol. In general, a rotatable trip bar is provided in each case for initiating a tripping operation in the circuit breaker in response to either an electrothermal stimulus or an electromagentic stimulus. The electrothermal stimulus is related to $I^2t=K$, or said in another way, the amount of overload current present over a predetermined period of time. The electromagentic stimulus is related to short circuit conditions, sometimes referred to as an instantaneous tripping situation. Generally, the calibration of the electrothermal stimulus is related to the angular swing through which the trip bar rotates in response to impingement thereon by a bimetallic member. On the other hand, response to the short circuit condition is related to how quickly an armature can be attracted to an electromagnetic member. In each case, the current flowing in the main terminals of the circuit breaker provides input for the electrothermal or electromagnetic response. As the size of the circuit breaker apparatus is reduced during miniaturization thereof, the need for a highly calibrated and repeatable electrothermal movement requires the continued use of a relatively high angular swing. However, quick electromagnetic response requires a minimum air gap. It is desirable to utilize each of these functions however, it can be seen that the two functions begin to work against each other. That is if the angular movement for thermal response is kept high for calibration repeatability the air gap remains necessarily large and undesirable. On the other hand if the air gap is reduced for the armature of the magnet the angular swing is correspondingly reduced. It would be desirable therefore if the angular swing associated with electrothermal reaction could be kept large and the air gap associated with an electromagnetic reaction could be kept small without affecting the calibration of the electrothermal operation.

SUMMARY OF THE INVENTION

In accordance with the invention a trip arm for a molded case circuit breaker apparatus is provided with a flexibly hinged armature on one portion thereof. The hinging only works in one rotational direction so that when the armature is actuated electromagnetically it moves as one member without the hinging effect. But when it is operated electrothermally the rotation occurs with the armature abutting against the magnetic member. The hinging effect allows for continued angular rotation of the trip bar even though the magnetic mechanical portion has been stabilized. This allows for a high degree of calibration and repeatability.

BRIEF DESCRIPTION OF THE DRAWINGS

For a better understanding of the invention, reference may be had to the preferred embodiment thereof shown in the accompanying drawings in which.

DESCRIPTION OF THE PREFERRED EMBODIMENT

Figure 1:
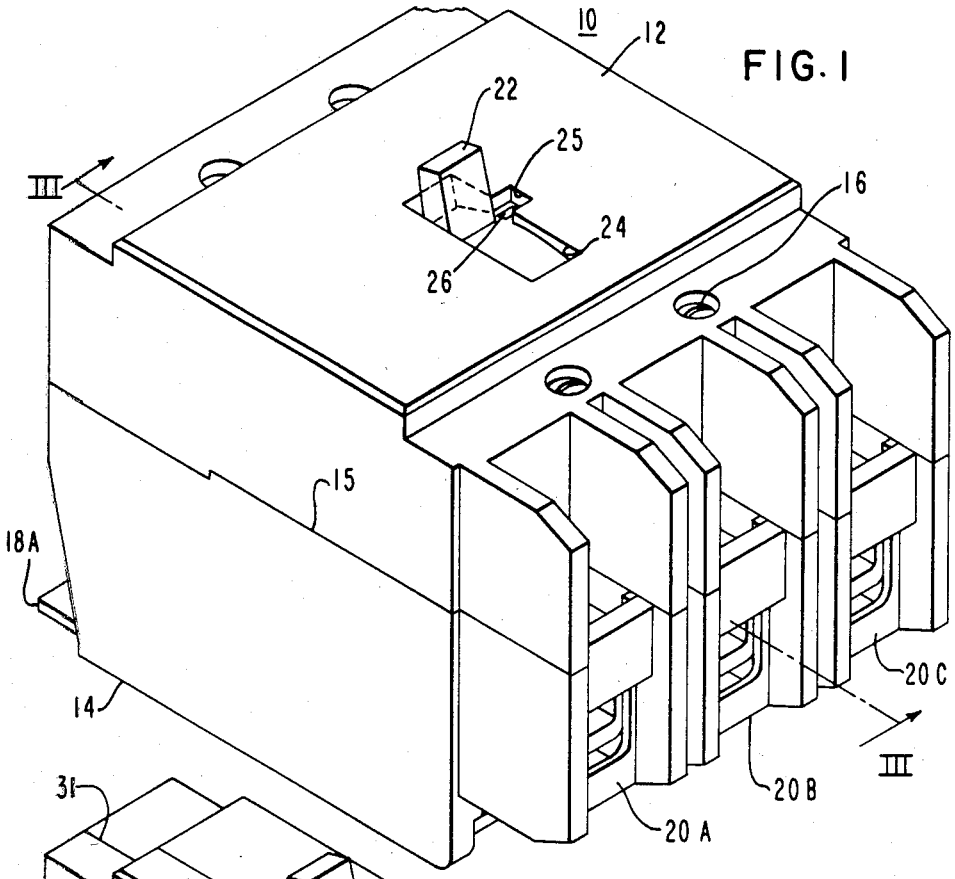
FIG. 1 shows an orthogonal view of a three phase molded case circuit breaker.

Referring now to the drawings and FIG. 1 in particular, a three phase molded case circuit breaker 10 is shown. Molded case circuit breaker 10 includes an electrically insulatably molded front cover 12 which is joined to a similar molded base 14 at an interface 15 and is secured thereto by way of screws 16. There is provided a line terminal 18A for the first of the three phases (the other line terminals are not shown). Correspondingly, there are provided three collar assembly terminals 20A, 20B, and 20C for each of the three phases, terminal 20A corresponding to line terminal 18A and so on. There is provided a handle 22 which is movable in an opening 24 in the front cover 12. An auxiliary opening 25 is provided as an extension of opening 24 to provide a window through which a white indicator, indicia or spot 26 may be exposed when the handle 22 is in a position indicative of the circuit breaker being TRIPPED. The dot or indicia 26 may be hot stamped onto an arcuate portion of the base of the handle 22. This provides a clear visual indication that the circuit breaker 10 is in the TRIPPED position because when it is in another position the dot is hidden under the remaining portion of the front cover 12 not described by the opening 24 or the auxiliary opening or window 25.

Figure 2:
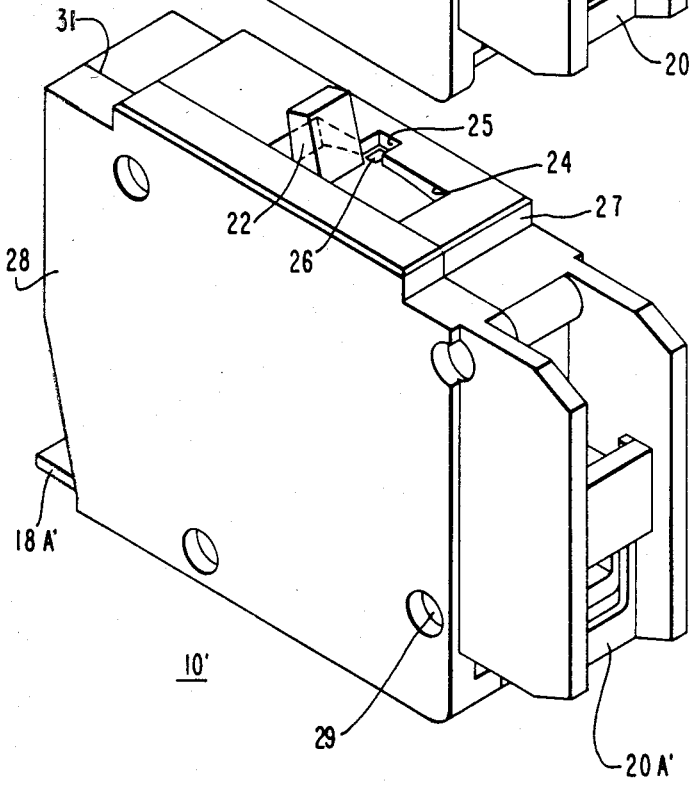
FIG. 2 shows an orthogonal view of a single phase molded case circuit breaker.

Referring now to FIG. 2 a single phase molded case circuit breaker apparatus 10' is shown. Circuit breaker apparatus 10' includes a right molded insulating cover 27 and a left molded insulating cover 28 joined and secured together by way of rivets 29 at an interface 31. There is provided an upper line terminal 18A' similar to line terminal 18A of the apparatus of FIG. 1 and a lower terminal or collar assembly 20A' similar to lower terminal or collar assembly 20A of FIG. 1. In a like manner, handle assembly 22, which is freely movable in an opening 24 in the cover 27, is provided. An additional extension opening 25 is provided through which an indicating means 26, similar to the indicating means 26 described with respect to FIG. 1, may be viewed when the circuit breaker apparatus 10′ is in the TRIPPED position.

Figure 3:
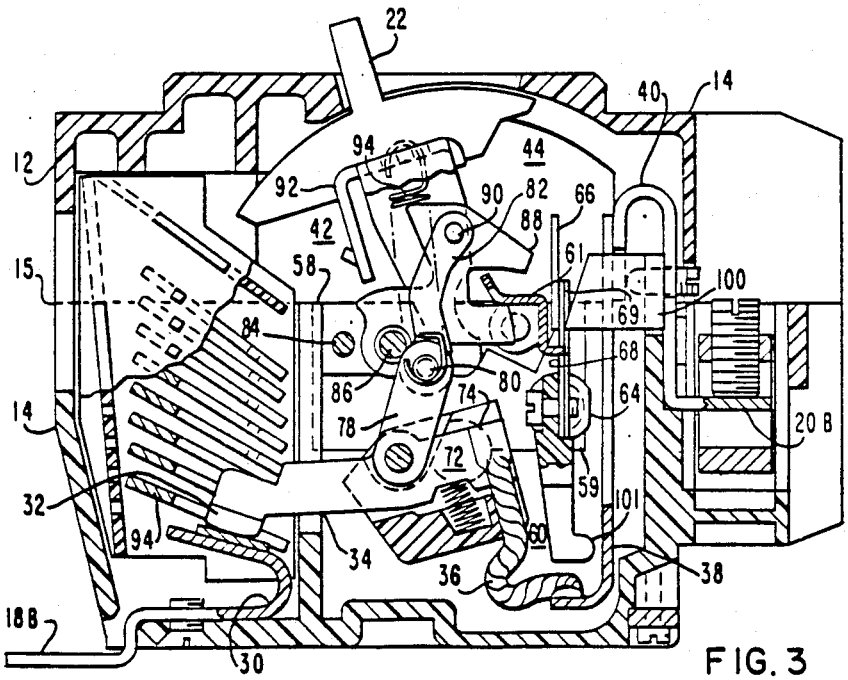
FIG. 3 shows a side elevation partially in section of the apparatus of FIG. 1 with the operating mechanism in the ON position taken at the section III—III of FIG. 1.
Figure 4:
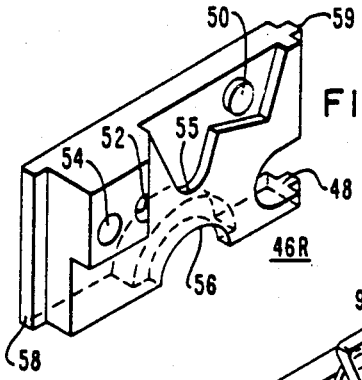
FIG. 4 shows an orthogonal view of a cast side piece for an operating mechanism support assembly.
Figure 11:
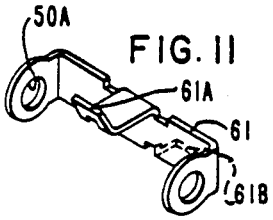
FIG. 11 shows an orthogonal view of an intermediate latch member.
Figure 7:
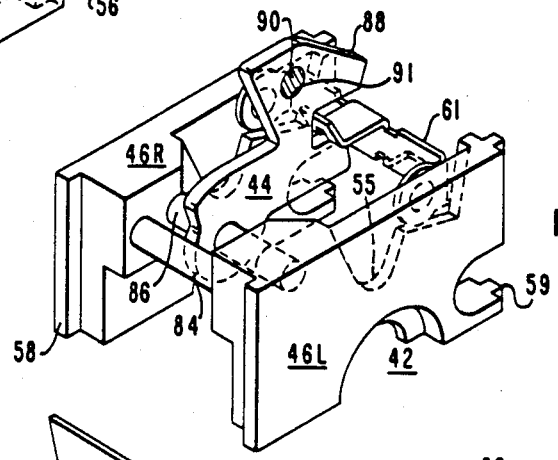
FIG. 7 shows an orthogonal view of a support assembly.
Figure 12:
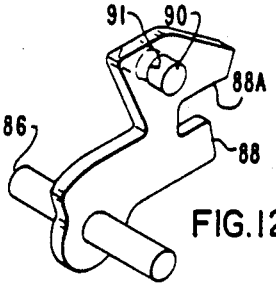
FIG. 12 shows an orthogonal view of a releasable cradle.
Figure 5:
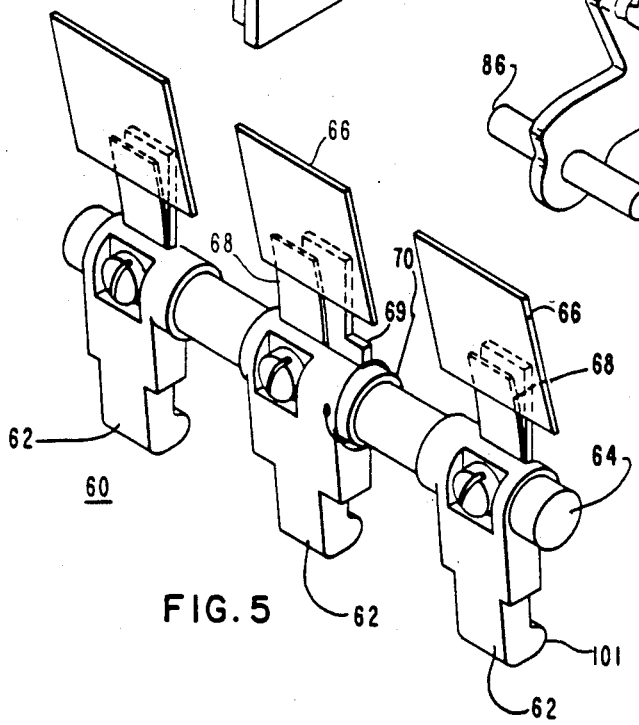
FIG. 5 shows an orthogonal view of a trip bar assembly.
Figure 6:
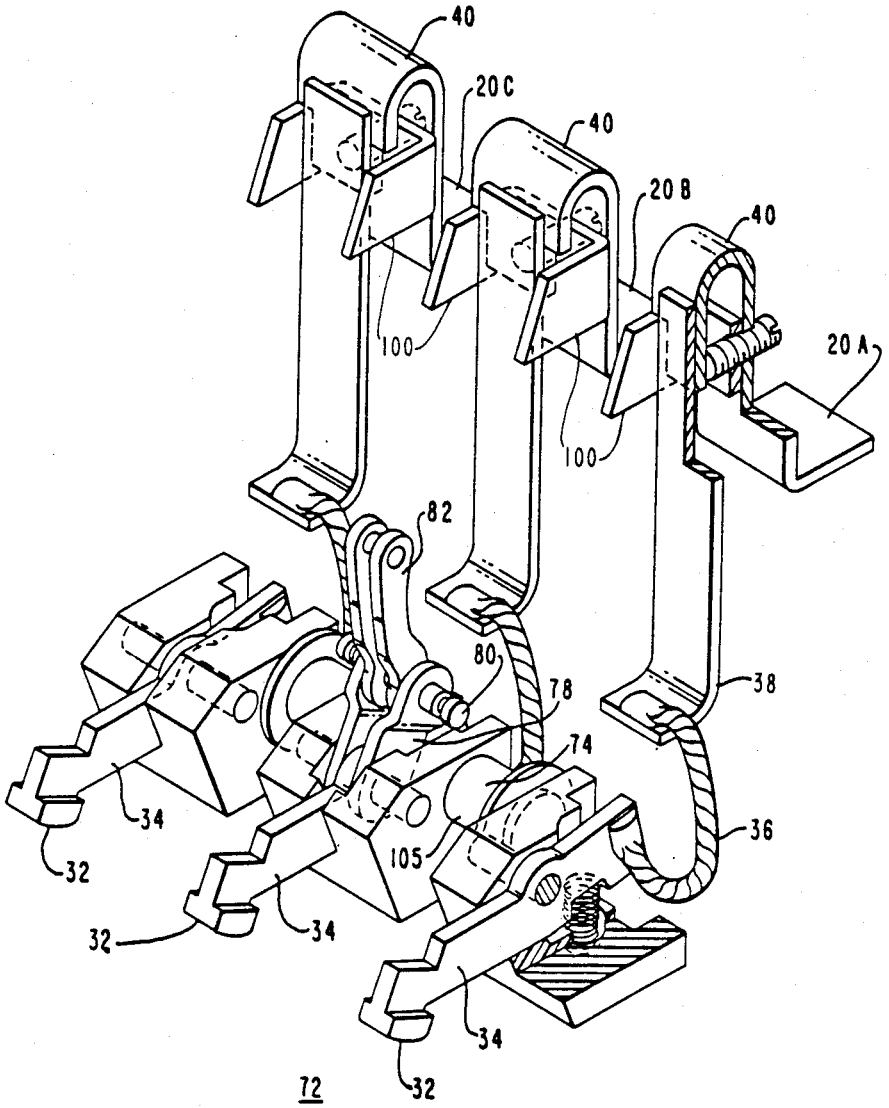
FIG. 6 shows an orthogonal view of a yoke bar assembly.

Referring now to FIGS. 3 through 7, FIG. 11 and FIG. 12, the internal portion of the molded case circuit breaker 10 of FIG. 1 is shown. Line terminal 18B is interconnected with a fixed internal contact 30. Movable contact 32 is movably operable to be placed into or out of a disposition of electrical continuity with fixed contact 30 depending upon the status of the operating mechanism 44. Electrical continuity between line terminal 18B and collar assembly 20B is provided by way of fixed contact 30, movable contact 32 when closed against fixed contact 30, contact arm 34, flexible conductor 36, bimetal 38 and lower contact extension 40. Support assembly 42 best shown in FIG. 7, supports portions of an operating mechanism 44 which in turn cooperates with a trip bar assembly 60 best shown in FIG. 5 and an intermediate latch 61 best shown in FIG. 11 to cause the separation and joining of the contacts 30 and 32 in response to the status of electrical current flowing in the terminals 18B and 20B or the manual disposition of the switch handle 22. FIG. 4 shows a die cast zinc support member 46R for support assembly 42 for which a mirror image similar die cast member 46L (as best shown in FIG. 7) also exits. For purposes of simplicity of illustration, member 46R will be described in detail, it being understood that member 46L is closely related. Member 46R has disposed in one portion thereof a trip bar axle bearing and guide 48 into which a trip bar axle 64 for the trip bar assembly 60, as shown in FIG. 5, may be inserted for rotational movement. There is also provided an intermediate latch pivot bearing surface 50 onto which the intermediate latch 61 may be rotatably displaced at 50A as best shown in FIG. 7 and FIG. 11. There is also provided a releasable cradle pivot bearing surface 52 into which a releasable cradle 88 as is best shown in FIG. 7 and FIG. 12 may be rotatably supported at axle 86. Also, a spacer and stop assembly support opening 54 is provided into which a spacer and stop bar 84 such as best shown in FIG. 7 may be inserted. A main contact arm axle bearing surface 56 suitable for pivotably supporting a portion of the yoke bar 74 of the contact arm assembly 72 as best shown in FIG. 6 is provided. Also, there is provided a lip 58 and a lip 59 which cooperate with flange portions on the base 14 for holding the support assembly 42 within the base assembly 14.

Referring specifically to FIG. 5, a trip bar assembly 60 is shown. Trip bar assembly 60 may include three trip bars 62 which are preferably made of molded electrically insulating material and a trip bar axle 64 which may be a molded integral part of each of the latch trip bars 62. A magnetic armature member 66 is flexibly attached to the trip bar axle 64 by way of a flexible attachment member 68 which may be formed from sheet spring steel or a similar material. The flexible attachment member 68 and the attached magnetic armature 66 flexes relative to the remainder of the trip bar 60 for purposes which will be described hereinafter.

Referring now more specifically to FIGS. 3 and 6, the contact assembly 72 is shown. The contact assembly 72 includes a yoke bar 74 which is preferably made of electrically insulating material and into which is disposed the aforementioned contact arm 34 with the appropriate movable contact 32 attached to one end thereof. The flexible conductor 36 and the contact extension 40 are attached to the other end thereof for each phase. Rotational movement of the yoke bar 74 and the consequential engagement of the movable contact 32 with the fixed contact 30 is caused by the movement of a lower toggle link 78 which is rotationally secured to the yoke bar 74 at one end of the yoke bar 74 and which is attached by way of a pivot joint or pin 80 at the other end thereof to an upper toggle link 82.

Referring once again to FIG. 7 and to FIG. 3, FIG. 5 and FIG. 12, a releasable cradle member 88 is shown. Releasable cradle member 88 is interconnected with the upper toggle link member 82 by way of a pin 90 inserted through a hole or opening 91 in the releasable cradle 88. Releasable cradle 88 in turn is rotationally affixed to the support assembly 42 by way of the releasable cradle axle or pin 86. A toggle arrangement is formed between the lower toggle member 78 and the upper toggle member 82. A biased arrangement of the toggle member interrelationship is maintained in one of two stable states by the utilization of a spring 94 which is captured between pin 80 and a portion of the handle assembly 22. In the disposition shown in FIG. 3, the arrangement of the operating mechanism 44 is such that the handle 22 and the contact 32 are maintained in an ON disposition by the intercooperation of the intermediate latch 61 and the trip bar assembly 60. Intermediate latch 61 is caught or captured by the trip bar lock member 69 and held in that disposition by the compressive action of the spring 94 operating on the handle assembly 22. Rotational movement of the trip bar assembly 60 in the clockwise direction will allow for similar rotational movement of the intermediate latch 61 under the influence of the spring 94 to cause releasable cradle 88 to rotate in a counterclockwise direction about pin 86, as viewed in FIG. 3, to cause pin member 80 to drop downwardly in the view depicted in FIG. 3 under the influence of the spring 94 to cause opening of the movable contact 32 in an appropriate TRIP situation. The TRIP disposition may be brought about by the energization of an electromagnet 100 which is part of the electrically conductive path between the collar 20B and the bimetal 38 which in turn electromagnetically influences the armature 66 of FIG. 5, thus causing rotation of the trip bar assembly 60. Trip bar assembly 60 may be rotated clockwise by the heating of the bimetal 38 due to electrical current therein. The bimetal 38 will then impinge upon a tip 101 of the trip bar 62, causing clockwise rotation of the trip bar assembly 60, thus freeing the intermediate latch 61 as described previously. Were the magnetic armature 66 not flexibly interconnected by member 68 to the trip bar 62, movement of the bimetal 38 against the trip bar 62 would be impeded by the interaction or touching of the electromagnet 100 and the armature 66. This would have a tendency to change the calibration between the bimetal 38 and the trip bar assembly 60, thus causing a problem related to reliability and repeatability with respect to certain ranges of overload currents which in turn are related to the amount of heat being produced in the circuit to be protected. The latter phenomenon is known as the $I^2t=K$ relationship. However, since the armature 66 is flexibly attached to the trip bar 62 by way of the member 68, significant clockwise rotational movement of the trip bar assembly 60 about its pivot or axle 64 is possible on a reliable repeatable basis because of the fact that the flexible member 68 will flex to accommodate the motion even though the magnetic armature 66 is placed flush against the angular face of the electromagnet 100. One purpose of the intermediate latch 61 is to give a mechanical advantage to the tripping process associated with the operating mechanism of the circuit breaker. The intermediate latch reduces overall latch load, therefore gives more sensitive tripping, and therefore gives greater repeatability. On a short circuit condition there is less friction, therefore quicker unlatching and therefore quicker interrupting of the circuit. It has been calculated that the difference between utilizing the intermediate latch 61 and not utilizing an intermediate latch in terms of loading is the difference between 1.5 pounds of force and 10 pounds of force respectively for an embodiment of the present invention. Furthermore, since the force required for tripping is smaller, this allows for a smaller cradle arm 88, thus providing a smaller, more compact circuit breaker. The present circuit breaker apparatus is approximately 40% smaller than its predecessor circuit breaker apparatus for the same parameters of protection.

Figure 8:
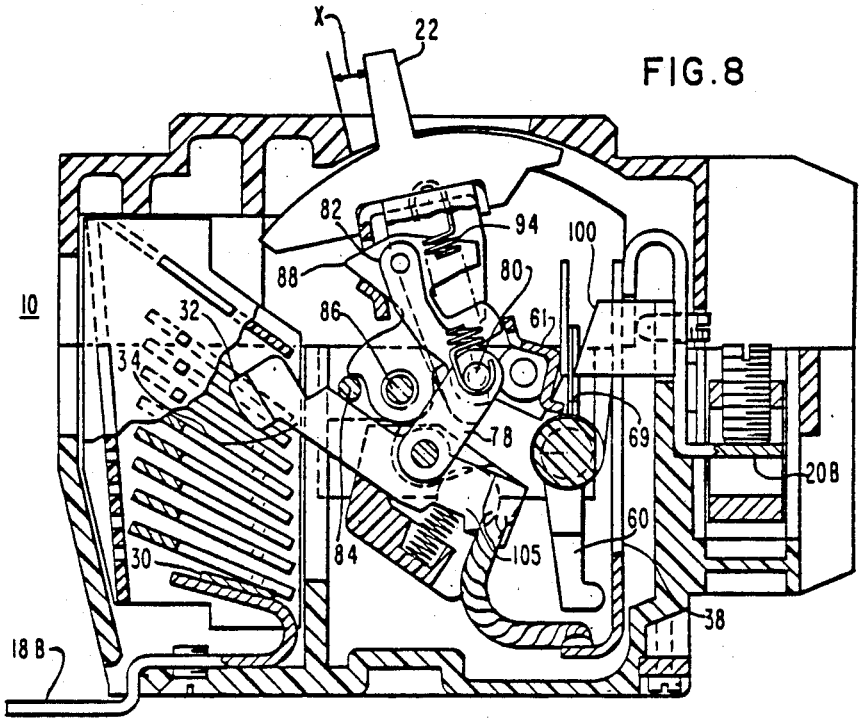
FIG. 8 shows a view similar to that of FIG. 3 with the operating mechanism of the circuit breaker in the TRIPPED position.

The disposition of the handle assembly 22 as shown in FIG. 8 in the TRIPPED position for the circuit breaker apparatus is such that the white indicia or indicating means 26 of FIG. 1 is shown in the cut-out window or opening 25 to thus provide a visual indication to an operator that the circuit breaker is in the TRIPPED state. In the TRIPPED disposition, the handle 22 is in a disposition close to the disposition shown in FIG. 3 but slightly offset in a clockwise direction as indicated by the distance X from the disposition shown in FIG. 3. The white indicia is viewable in the auxiliary opening 25 in this position. This is also the disposition shown in FIG. 1. In this case either the electromagnet device 100 or the bimetal 38 has caused a previous rotational movement of the trip bar 60 in the clockwise direction to allow the intermediate latch 61 to be free of the lock member 69 of the trip bar assembly 60 to cause rotation thereof to the disposition shown in FIG. 8. This allows the releasable cradle 88 to rotate counterclockwise upwardly against the stop bar 84 to allow the spring 94 to collapse the toggle members 78 and 82 to cause the yoke bar 74 to rotate clockwise about its axle 105 to cause the arm 34 to correspondingly rotate in the clockwise direction to thus disengage the movable contact 32 from the fixed contact 30, thus interrupting the current between the line terminal 18B and the collar terminal 20B. The disposition shown in FIG. 8 is caused by the clockwise rotation of the trip bar assembly 60.

Figure 9:
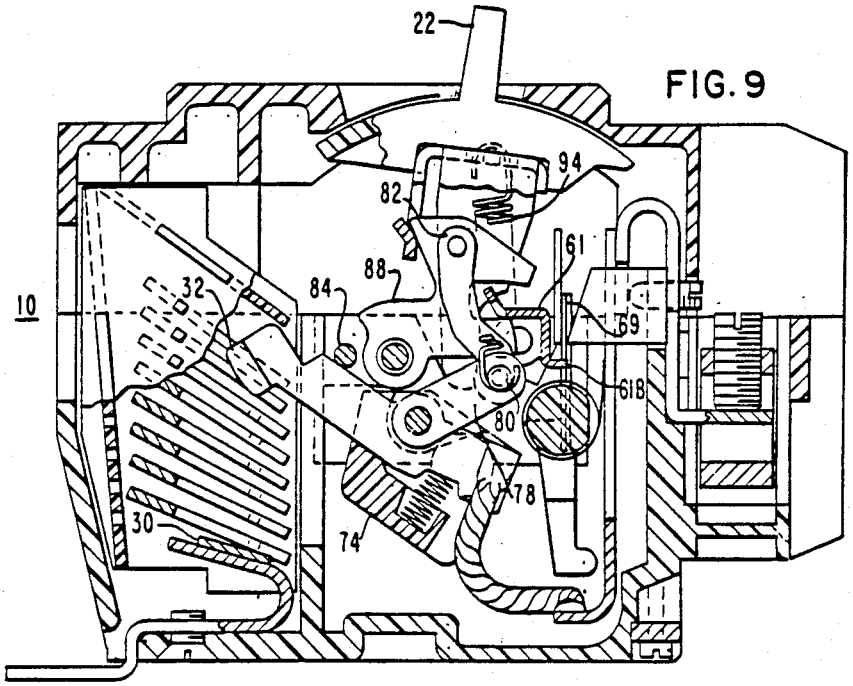
FIG. 9 shows a view similar to that of FIG. 8 but with the operating mechanism in the OFF position.
Figure 10:
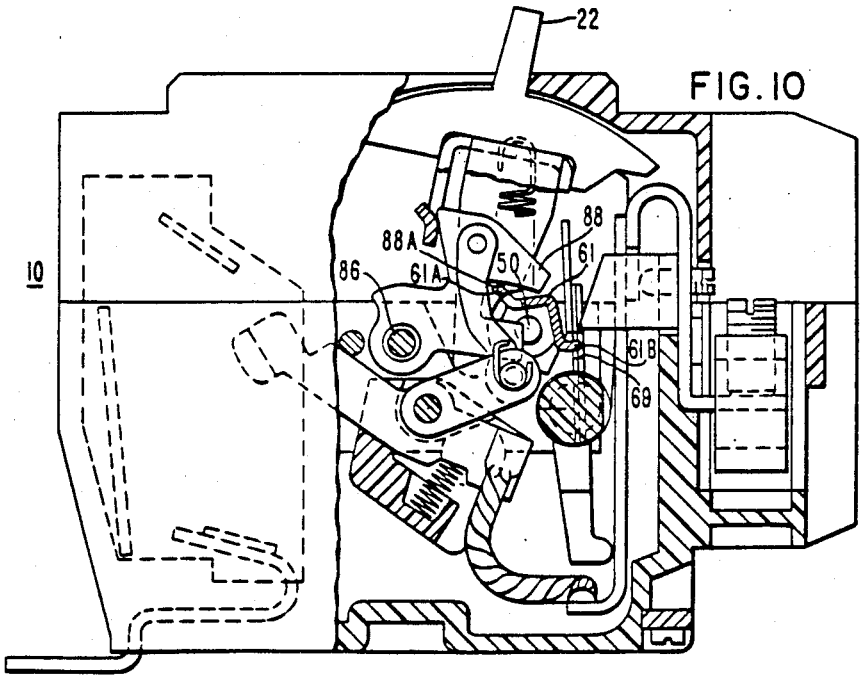
FIG. 10 shows a view similar to that of FIG. 8 but with the operating mechanism in a RESET state.

Referring now to FIG. 9, the OFF position for the circuit breaker apparatus 10 is shown. The difference between the disposition shown in FIG. 8 and the disposition shown in FIG. 9 lies in the fact that the intermediate latch 61 remains engaged for subsequent tripping by electromechanical or electrothermal means in the disposition shown in FIG. 9 whereas that is not the case in the disposition shown in FIG. 8. This means that if the circuit interrupter contacts are to be reengaged from the disposition shown in FIG. 8, then a mechanical reset of the handle 22 similar to that shown hereinafter with respect to FIG. 10 is necessary. Such is not the case with respect to the disposition shown in FIG. 9 where the contacts may be closed merely by moving the handle 22 to the disposition shown in FIG. 3. With respect to the disposition of the operating mechanism of FIG. 9 it will be noted that the releasable cradle 88 remains in the disposition shown with respect to FIG. 3. However, the linkages 78 and 82 have nevertheless been rendered to a collapsed disposition by the previous movement of the handle 22 in the downward direction. This has the effect of changing the operating mechanism 44 from a first stable toggle position such as is shown in FIG. 3 to a second stage toggle position such as is shown in FIG. 9. All of the toggle positions are influenced by the spring 94. In the disposition shown in FIG. 9, the pin 80 is disposed further to the left and downwardly of the disposition shown in FIG. 8. The net effect is to nevertheless cause the yoke bar 74 to rotate in such a manner that the contacts 32 and 30 are disengaged. By moving the handle 22 to the disposition shown in FIG. 3, the latter contacts can be manually closed again.

With regard to the dispositions of FIG. 3 and FIG. 9, an electromagnetic energization of the electromagnet 100 or an electrothermal energization of the bimetal 38 would cause an unlatching or tripping of the operating mechanism 44. However, it is to be noted that the electrical energy necessary for electromechanical or electrothermal energization of the trip bar 60 cannot occur with respect to the apparatus of FIG. 9 because the contacts 32 and 30 are separated and therefore the current, which is necessary for the energization, cannot be present.

Referring finally to the operating mechanism disposition shown in FIG. 10 in conjunction with FIG. 11 and FIG. 12, a RESET handle location is shown. The RESET handle position is similar to the handle position shown in FIG. 9 except that the handle 22 is depressed even further in a clockwise direction to the lower disposition to effectuate clockwise movement of the cradle means 88 about rotational pin 86 to thus cause an abutment of the intermediate latch 61 at region 61A with surface 88A of the releasable cradle 88. This causes counterclockwise rotation of the intermediate latch 61 about the axle or pivot 50, thus causing the tip 61B of latch 61 to rotate in a counterclockwise direction past the lock member 69 of the trip bar assembly 60. The disposition shown in FIG. 10 is a momentary non-stable disposition and release of the handle 22 will cause the handle member 22 to rotate upwardly in a counterclockwise direction to the disposition shown in FIG. 9 where the tip or protrusion 61B is captured or caught against the lock member 69. The circuit breaker apparatus contacts 32 and 30 can then be joined or closed by the movement of the handle 22 to the on disposition shown in FIG. 3.

Referring to FIGS. 3 and 5, it is noted that the bimetal 38 of FIG. 3 for example must be allowed to move through a wide angular range or the calibration of the bimetal 38 may change. In the past, a single armature was rigidly tied to the trip bar in order to accommodate the wide range. The gap between the electromagnet 100 and the armature 66 had to be large. But it is more desirable to have a small air gap for fast response under short circuit conditions, therefore the arm is flexibly attached to member 62 by member 68 to provide for the necessary flexibility.

It is to be understood with respect to the embodiments of this invention that the inventive concepts taught herein are not limited to single phase or triple phase circuit breakers but are usable on double phase circuit breakers and other polyphase circuit breakers. It is also to be understood that the concepts are usable in DC circuit breakers as well as AC circuit breakers. It is also to be understood that the use of the metal zinc for the support member 46R, for example, is not limiting and other suitable castable materials, preferably metals, may be utilized.

The present invention has many advantages. One advantage lies in the fact that the compactness of the circuit breaker requires smaller members travel to perform the same functions as would be required in larger circuit breaker apparatus. The reduction in the size may result in an overall reduction in the calibration quality of the circuit breaker apparatus because calibration quality is often related to travel distances. In the present invention it is desirable to allow the bimetal member to be allowed to move freely through a wide angular range. Otherwise, a "set" can result on the bimetal member which will change the calibration thereof. It is desirable, furthermore, to have a small air gap between the magnetic portions of the trip members. A small air gap results in fast response. In order for this to be accommodated the armature member is flexibly attached to the trip bar in one angular direction but not in the other angular direction. This means that when the trip bar is acting under the effect of electromagnetic stimulus the small air gap can be quickly traversed and the circuit breaker TRIPPED, on the other hand when the trip bar is operated electrothermally the wide range required by the bimetal can be accommodated because the armature member will flex when its travel has been interrupted.

What we claim as our invention is:

1. A circuit interrupter, comprising:

(a) enclosure means;

(b) separable contact means disposed within said enclosure means for opening to protect an electrical system;

(c) operating means disposed within said enclosure means in a state of cooperation with said contact means for causing said contact means to open; and (d) trip means disposed within said enclosure means in a state of cooperation with said operating means for initiating said operating means to open said contact means, said trip means comprising:

(i) trip bar means capable of a predetermined amount of calibrated rotational movement in a predetermined rotational direction in reponse to thermal or magnetic stimuli for causing said initiation;

(ii) thermal means cooperative with said trip bar means for causing said predetermined amount of calibrated rotational movement in said predetermined rotational direction; and (iii) magnetic means attached to said trip bar means, said magnetic means comprising a magnetic armature which is attached to said trip bar means by a leaf spring, said magnetic means also comprising an electromagnet, an end portion of said trip bar being positioned between said leaf spring and said electromagnet, said electromagnet being spaced from said armature during non short-circuit electrical conditions in said system by a predetermined air gap distance, which distance encourages quick response to a short circuit electrical condition in said system by allowing said electromagnet to quickly pull said armature across said air gap in said predetermined direction and against said electromagnet thus rotating said armature correspondingly in said predetermined direction until said air gap is reduced to zero, said armature being rotationally moved less than said predetermined amount by said magnetic means, further rotation of said trip bar means in the same rotational direction by said thermal means to a place related to said predetermined amount of calibrated rotational movement being allowed within limits as said leaf spring flexes as said trip bar continues to rotate while said attached armature remains stationary against said electromagnet.

2. The combination as claimed in claim 1 wherein said thermal means is a bimetal device.

* * * * *